US008702079B2

(12) United States Patent
Sladojevic

(10) Patent No.: US 8,702,079 B2
(45) Date of Patent: Apr. 22, 2014

(54) MAGNETIC CLAMP ASSEMBLY

(75) Inventor: Robert Sladojevic, Blackwood (AU)

(73) Assignee: SRB Construction Technologies Pty Ltd, Blackwood (AU)

( * ) Notice: Subject to any disclaimer, the term of this patent is extended or adjusted under 35 U.S.C. 154(b) by 1120 days.

(21) Appl. No.: 12/310,963

(22) PCT Filed: Sep. 4, 2007

(86) PCT No.: PCT/AU2007/001293

§ 371 (c)(1),
(2), (4) Date: Oct. 2, 2009

(87) PCT Pub. No.: WO2008/031145

PCT Pub. Date: Mar. 20, 2008

(65) Prior Publication Data

US 2010/0013134 A1 Jan. 21, 2010

(30) Foreign Application Priority Data

Sep. 15, 2006 (AU) ..... 2006905118

(51) Int. Cl.

| | |
|---|---|
| ***B25B 11/00*** | (2006.01) |
| ***B25B 5/00*** | (2006.01) |
| ***E04G 11/06*** | (2006.01) |
| ***E04G 17/06*** | (2006.01) |

(52) U.S. Cl.

USPC ..... 269/8; 269/246; 249/40

(58) Field of Classification Search

USPC ..... 269/8, 216, 246; 294/219, 139, 25, 216, 294/43, 40, 217, 213, 194, 27

See application file for complete search history.

(56) References Cited

U.S. PATENT DOCUMENTS

| | | | | |
|---|---|---|---|---|
| 2,502,672 | A * | 4/1950 | Roither | 249/217 |
| 2,709,292 | A * | 5/1955 | Otti | 249/43 |
| 2,946,360 | A * | 7/1960 | Solo | 269/209 |
| 2,954,257 | A * | 9/1960 | Besuch et al. | 248/206.5 |
| 3,014,751 | A | 12/1961 | Smith | |
| 3,319,989 | A | 5/1967 | Ross | |
| RE26,710 | E * | 11/1969 | Barnes | 249/40 |
| 3,507,473 | A * | 4/1970 | Blonde | 249/27 |
| 3,648,961 | A * | 3/1972 | Farrow | 249/43 |
| 3,917,216 | A * | 11/1975 | Plough | 249/48 |
| 3,926,404 | A * | 12/1975 | Lovisa et al. | 249/213 |
| 4,159,097 | A * | 6/1979 | Strickland | 249/40 |
| 4,634,359 | A * | 1/1987 | Sartorio | 425/89 |
| 4,726,560 | A * | 2/1988 | Dotson | 249/43 |
| 5,066,936 | A | 11/1991 | Hsu | |

(Continued)

FOREIGN PATENT DOCUMENTS

| | | |
|---|---|---|
| DE | 202 654 A | 9/1983 |
| DE | 297 02 835 U1 | 6/1998 |

(Continued)

*Primary Examiner* — Alvin Grant
(74) *Attorney, Agent, or Firm* — Seed IP Law Group PLLC

(57) ABSTRACT

A magnetic clamp assembly includes a magnetic clamp housing. The housing has a front face and a pair of opposes sides. A restraining arrangement comprises a restraining formation projecting outwardly from each side of the housing parallel to the front face. An adapter is mountable to the housing to bear against the front face. The adapter includes an engaging arrangement which engages the restraining arrangement when the adapter is mounted to the housing to restrain pivoting movement of the adapter relative to the housing.

12 Claims, 6 Drawing Sheets

(56) References Cited

U.S. PATENT DOCUMENTS

| | | | | |
|---|---|---|---|---|
| 5,146,816 | A * | 9/1992 | Badstieber | 81/487 |
| 5,282,603 | A * | 2/1994 | Taraldsson | 249/35 |
| 5,993,365 | A | 11/1999 | Stagnitto et al. | |
| 6,202,978 | B1 | 3/2001 | Vappula | |
| 6,276,657 | B1 | 8/2001 | Vappula | |
| 6,434,894 | B2 | 8/2002 | Reymann | |
| 6,471,273 | B1 * | 10/2002 | Friedrich et al. | 294/65.5 |
| 6,477,816 | B1 * | 11/2002 | Di Biase | 52/588.1 |
| 6,547,209 | B1 * | 4/2003 | Vappula | 249/139 |
| 6,733,059 | B2 * | 5/2004 | Flathau | 249/194 |
| 6,742,759 | B2 * | 6/2004 | Vappula | 249/139 |
| 6,837,473 | B2 * | 1/2005 | Petkau | 249/216 |
| 6,854,777 | B2 | 2/2005 | Jung | |
| 6,969,056 | B2 * | 11/2005 | Sato et al. | 269/216 |
| 7,419,131 | B2 | 9/2008 | Von Limburg | |
| 7,548,147 | B2 | 6/2009 | Chiang | |
| 7,850,142 | B2 * | 12/2010 | Sladojevic et al. | 249/219.1 |
| 7,887,022 | B2 | 2/2011 | Von Limburg et al. | |
| 8,002,234 | B2 * | 8/2011 | Rodin | 249/25 |
| 8,292,242 | B2 * | 10/2012 | Thompson | 248/206.5 |
| 8,322,699 | B2 * | 12/2012 | Prell et al. | 269/246 |
| 2005/0116131 | A1 | 6/2005 | Samuel | |
| 2005/0258319 | A1 * | 11/2005 | Jeong | 248/176.1 |
| 2007/0131829 | A1 | 6/2007 | Thompson | 248/206.5 |

FOREIGN PATENT DOCUMENTS

| | | |
|---|---|---|
| EP | 0 945 238 B1 | 9/1999 |
| EP | 1 810 806 | 7/2007 |
| JP | 4-313593 A | 11/1992 |
| WO | 02/11951 | 2/2002 |

* cited by examiner

MAGNETIC CLAMP ASSEMBLY

CROSS-REFERENCE TO RELATED APPLICATIONS

The present application claims priority from Australian Provisional Patent Application No. 2006/905118 filed on 15 Sep. 2006, the contents of which are incorporated herein by reference.

BACKGROUND

1. Technical Field

This disclosure relates, generally, to the clamping of elements during a manufacturing process. More particularly, the disclosure relates to a magnetic clamp assembly. The disclosure also extends to an adapter for a magnetic clamp assembly and to a housing for a magnetic clamp assembly.

2. Description of the Related Art

Manufacture of concrete panels and structures is often carried out via pre-casting techniques. Pre-cast manufacture of concrete panels and structures is becoming the preferred method for many construction applications including industrial, commercial, and retail applications.

Typically, pre-casting of a concrete panel or other concrete member is performed on a steel bed. Steel beds can be constructed to have a surface with a relatively high level of precision. This allows concrete panels and structures to be manufactured to an associated level of accuracy. Edge or perimeter molds are used to produce concrete panels and structures of a certain shape. These molds are commonly referred to as sideforms. One of the ways to secure the sideforms in position on a steel bed is by the use of magnetic clamps.

In order to produce a concrete panel having a particular edge profile, it is necessary to use sideforms defining a complementary profile. It follows that sideforms come in many different shapes and sizes. To account for such variations, an adapter plate is mounted to the magnetic clamp. Thus, by having a range of adapter plates it is possible to select one which is suitable for a particular sideform and thus the magnetic clamp can be used to clamp a wide range of sideforms.

Once the concrete has been poured into the mold a final step in the pre-casting process involves leveling and settling the poured concrete. To achieve this, a vibrating device is oscillated back and forth across the surface of the poured concrete until the concrete is flush with a top of the sideforms and to aid in removing air pockets which may have formed within the concrete prior to the concrete setting. Oscillation of the vibrating device across the top of the sideforms causes a sympathetic oscillation to be set up in the top of the sideform. The oscillation of the sideform tends to loosen bolts which are conventionally used to mount the adapter to the magnetic clamp. The adapter plate may pivot relative to the magnetic clamp which may result in the adapter plate leaning away from the magnetic clamp and, consequently, the sideform not being supported perpendicularly to the bed as required.

BRIEF SUMMARY

According to one embodiment of the invention, there is provided a magnetic clamp assembly which includes:

a magnetic clamp housing, the housing having a front face, a pair of opposed sides and a pair of restraining formations, each restraining formation projecting outwardly from a respective side of the housing; and an adapter mountable to the housing to bear against the front face, the adapter including an engaging arrangement configured to engage the restraining formations when the adapter is mounted to the housing to restrain pivoting movement of the adapter relative to the housing.

By "pivoting movement" is meant, unless the context clearly indicates otherwise, flexure of the adapter about an axis parallel to a surface on which the housing is mounted, in use.

Each restraining formation may be arranged at, or adjacent, the front face of the housing to extend parallel to the front face of the housing and each restraining formation may be formed integrally with the housing as a one piece unit. Each restraining formation may be of a height which is less than a height of the housing. Instead, the height of each restraining formation may be substantially the same as the height of the housing.

The engaging arrangement may include an engaging element associated with each restraining formation. Each engaging element may be of a complementary configuration to the associated restraining formation and may be shaped to allow sliding movement of the adapter relative to the housing when mounting of the adapter to the housing.

Each engaging element may be claw-shaped to define a receiving formation for slidably receiving its associated restraining formation.

The engaging arrangement may be integrally formed with the adapter as a one piece unit.

At least one restraining formation, and, preferably both restraining formations, may include a limiting structure for limiting travel of the adapter relative to the housing when mounting of the adapter to the housing. The engaging arrangement of the adapter may interact with the limiting structure when the adapter is in its operative position relative to the housing.

The housing may define an operatively lower surface which rests on a work surface to which the housing is to be magnetically clamped, in use. The lower surface may be arranged in a plane substantially orthogonal to a plane in which the front face of the housing is arranged.

The adapter may carry a bearing member for bearing against an element to be supported in position by the magnetic clamp assembly. The adapter may include mounting formations for receiving securing elements to mount the adapter releasably to the housing. The assembly may include the securing elements arranged in a spaced relationship and projecting from the front face of the housing. Each securing element may be a bolt having a bolt head.

Each mounting formation may comprise an opening defined in the adapter, the opening being shaped to receive its associated securing element. The securing elements may serve to hold the adapter in position relative to the front face of the housing.

According to another embodiment of the invention, there is provided an adapter for a magnetic clamp assembly, the adapter including:

a body mountable to a housing of the magnetic clamp assembly; and an engaging arrangement integrally formed with, and extending from, an operatively rear region of the body, the engaging arrangement configured to engage restraining formations of the housing of the magnetic clamp assembly when the adapter is mounted to the magnetic clamp assembly to restrain pivoting movement of the adapter relative to the housing.

According to yet another embodiment of the invention, there is provided a housing for a magnetic clamp assembly, the housing including:

a casing having a front face for receiving an adapter; and a pair of restraining formations, each restraining formation projecting outwardly from a respective side of the housing parallel to the front face and configured to engage at least a portion of the adapter when the adapter is mounted to the casing to restrain pivoting movement of the adapter relative to the casing.

BRIEF DESCRIPTION OF THE SEVERAL VIEWS OF THE DRAWINGS

An embodiment of the invention is now described by way of example with reference to the accompanying drawings, in which.

DETAILED DESCRIPTION

Figure 2:
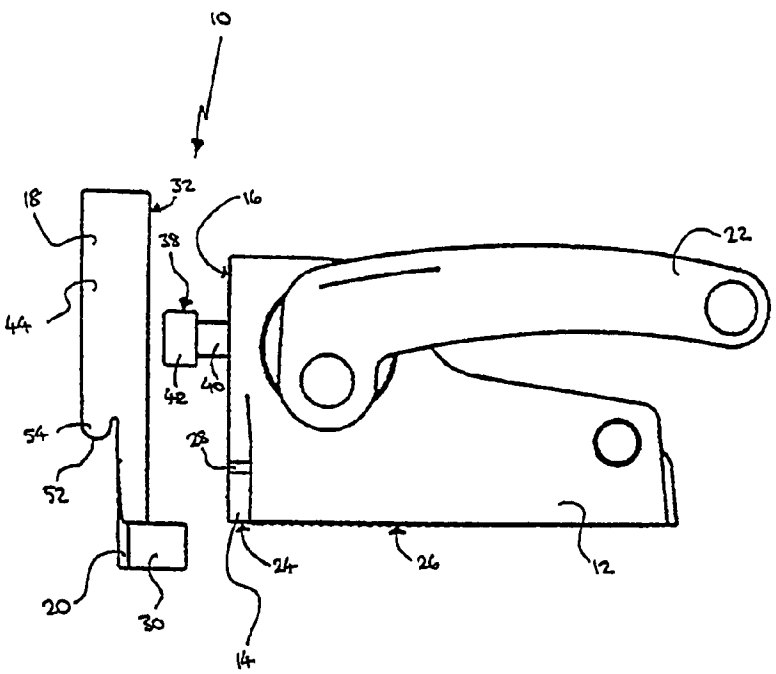
FIG. 2 shows an exploded, side view of the magnetic clamp assembly of FIG. 1.

In the drawings, reference numeral 10 generally designates an exemplary embodiment of a magnetic clamp assembly. The assembly 10 includes a housing 12. The housing 12 has a restraining arrangement comprising a pair of restraining formations, each of which is in the form of a tab 14. The tabs 14 project outwardly from their respective sides of the housing parallel to a front face 16 of the housing 12. The assembly 10 also includes an adapter 18 which is removably mountable to the housing 12. The adapter 18 has an engaging arrangement 20 which engages each tab 14 when the adapter 18 is mounted to the housing 12 to restrain pivoting movement (as defined) of the adapter 18 relative to the housing 12. The housing 12 houses a magnet (not shown) for magnetically clamping the housing 12 to a work surface (also not shown). The housing 12 carries an operating handle 22 which is in communication with the magnet such that movement of the handle 22 causes a corresponding movement of the magnet inside the housing 12. Movement of the handle 22 to a first position (as shown in the drawings) causes a corresponding downward movement of the magnet to engage the work surface magnetically and exerts a magnetic force for securely clamping the housing 12 to the work surface. Similarly, when the handle 22 is moved to a second position (at substantially right angles to the position shown in the drawings) the magnet is held within the housing 12 in an inactive state. In the inactive state, the magnetic force exerted by the magnet on the work surface is weak or non-existent and this allows an operator to position the assembly 10 as desired on the work surface.

The tabs 14 are integrally formed with the housing 12 as a one-piece unit. For example, the housing 12 and the tabs 14 may be of cast steel construction.

Figure 7:
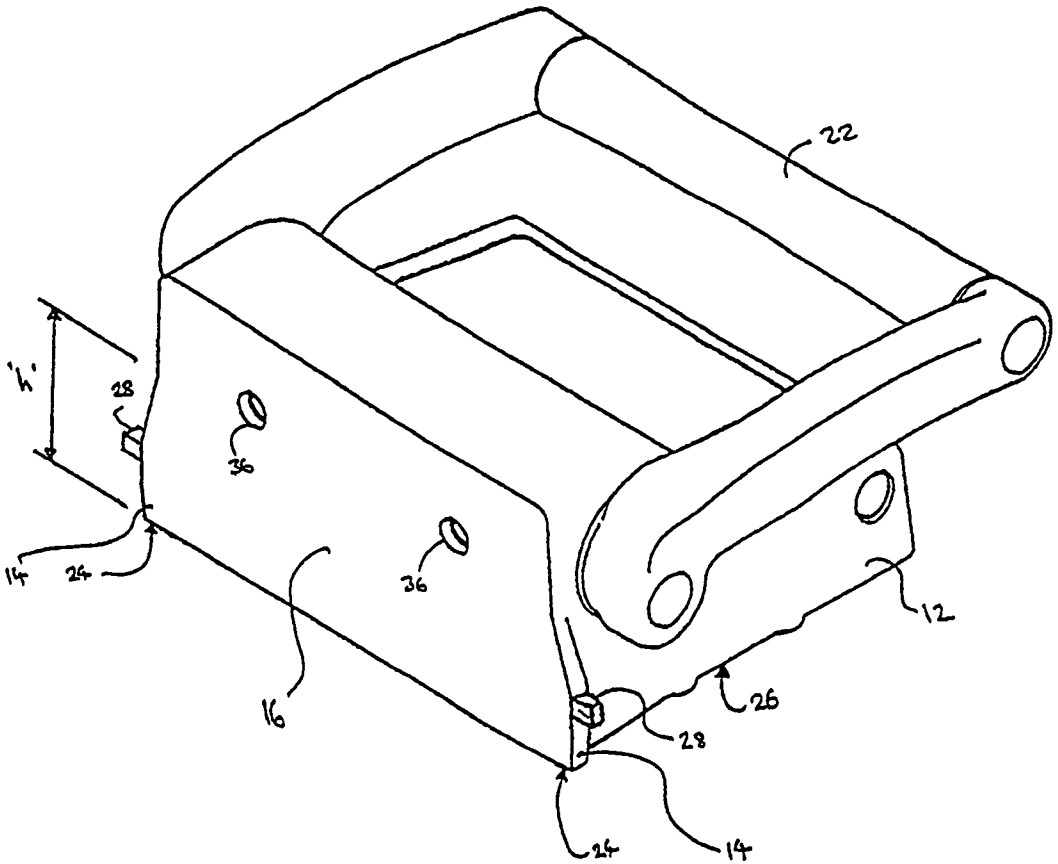
FIG. 7 shows a perspective view of a housing of the magnetic clamp assembly.

As most clearly shown in FIG. 7, each tab 14 is flush with the front face 16 of the housing 12. A lower edge 24 of each tab 14 is aligned with an operatively lower surface 26 of the housing 12. In use, the lower surface 26 of the housing 12 rests on the work surface. Each tab 14 extends upwardly from its associated lower edge 24 such that each tab 14 has a height dimension 'h' as shown in FIG. 7 less than that of the height of the front face 16 of the housing 12. In some embodiments, if it is desired, the height of the tabs 14 may be equal to the height of the front face 16 of the housing 12.

Each tab 14 carries a limiting structure in the form of an outwardly protruding lug 28. The lugs 28 act as stops for the engaging arrangement 20 to limit movement of the adapter 18 during attachment of the adapter 18 to the housing 12. As will be described in more detail below, when the adapter 18 is being mounted to the housing 12, the adapter 18 is moved to a position in which the engaging arrangement 20 abuts the lugs 28. This position is the mounting position.

Figure 10:
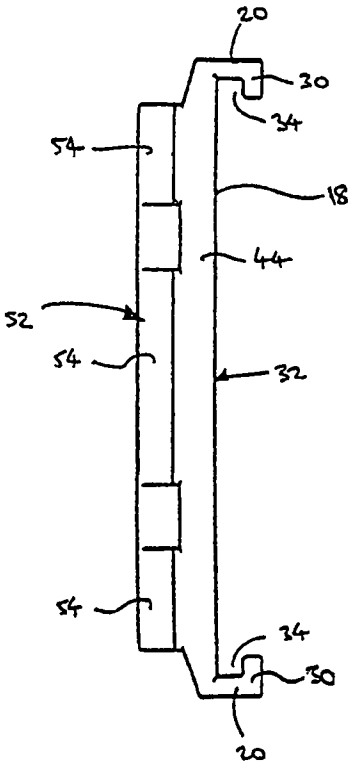
FIG. 10 shows a bottom plan view of the adapter.

The engaging arrangement 20 is integrally formed with the adapter 18 as a one-piece unit which enhances the ability of the assembly 10 to restrain pivoting movement of the adapter 18 relative to the housing 12. The engaging arrangement 20 has a rearwardly directed claw-shaped engaging component 30 associated with each tab 14 of the housing 12. Each engaging component 30 is of a complementary configuration to its associated tab 14. As most clearly shown in FIG. 10, each engaging component 30 is substantially L-shaped and, together with a rear surface 32 of the adapter 18, defines a slot 34 for slidably receiving its associated tab 14 when the adapter 18 is mounted to the housing 12. The slot 34 is dimensioned to provide a snug fit for its associated tab 14. It will be appreciated that, because each tab 14 is snugly received in its associated slot 34, the adapter 18 is restrained from pivoting movement relative to the housing 12.

The front face 16 of the housing 12 defines a pair of horizontally spaced tapped holes 36 for receiving threaded fasteners in the form of bolts 38 (FIG. 2). As shown in FIG. 2, each bolt 38 is threadedly received in its associated hole 36 so that a part of a shank 40 of the bolt 38 protrudes from the hole 36 and a head 42 of the bolt 38 is spaced from the front face 16 of the housing 12.

Figure 9:
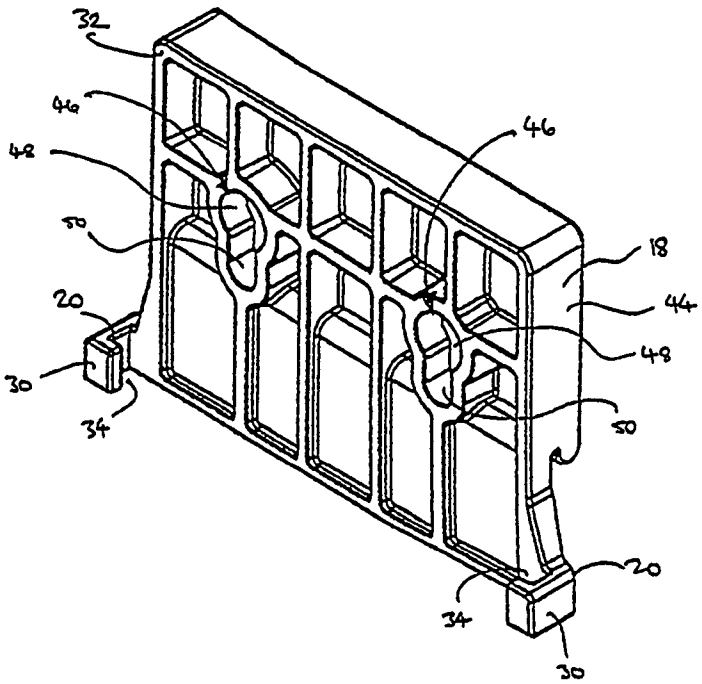
FIG. 9 shows a perspective rear view of the adapter.
Figure 8:
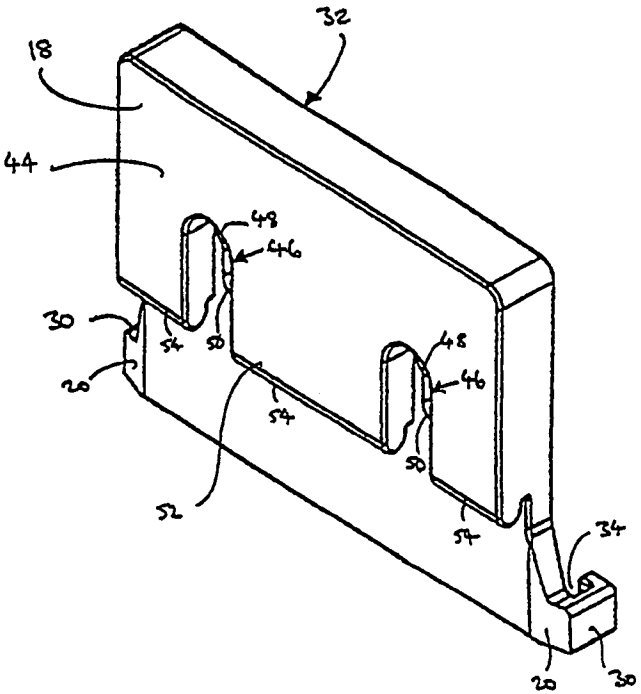
FIG. 8 shows a perspective front view of an adapter of the magnetic clamp assembly.

The adapter 18 has a body 44 which includes a mounting formation for each bolt 38. Each mounting formation is in the form of an opening 46. Each opening 46 is arranged to receive one of the bolts 38. As most clearly seen in FIG. 9, each opening 46 is keyhole-shaped. That is, each opening 46 has an enlarged portion 48 which is dimensioned to receive the head 42 of its associated bolt 38. A narrower portion 50 extends from enlarged portion 48 and is dimensioned to accommodate the shank 40 of the associated bolt 38.

Figure 1:
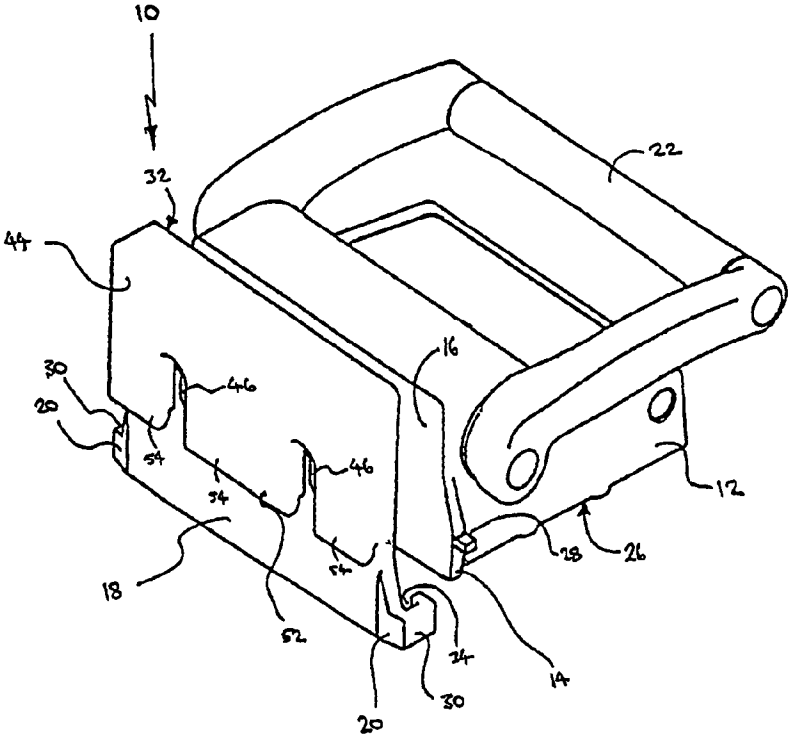
FIG. 1 shows an exploded, perspective view of a magnetic clamp assembly in accordance with an embodiment of the invention.
Figure 4:
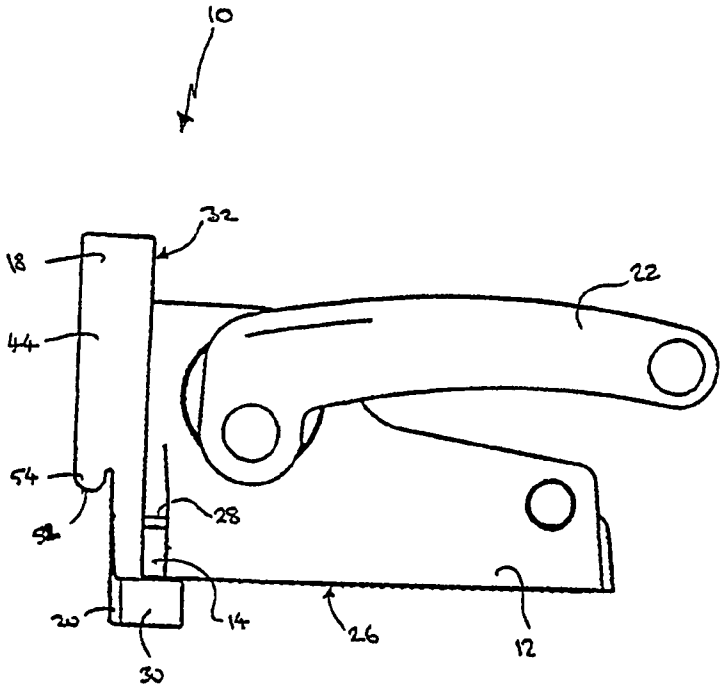
FIG. 4 shows a side view of the magnetic clamp assembly during attachment.
Figure 3:
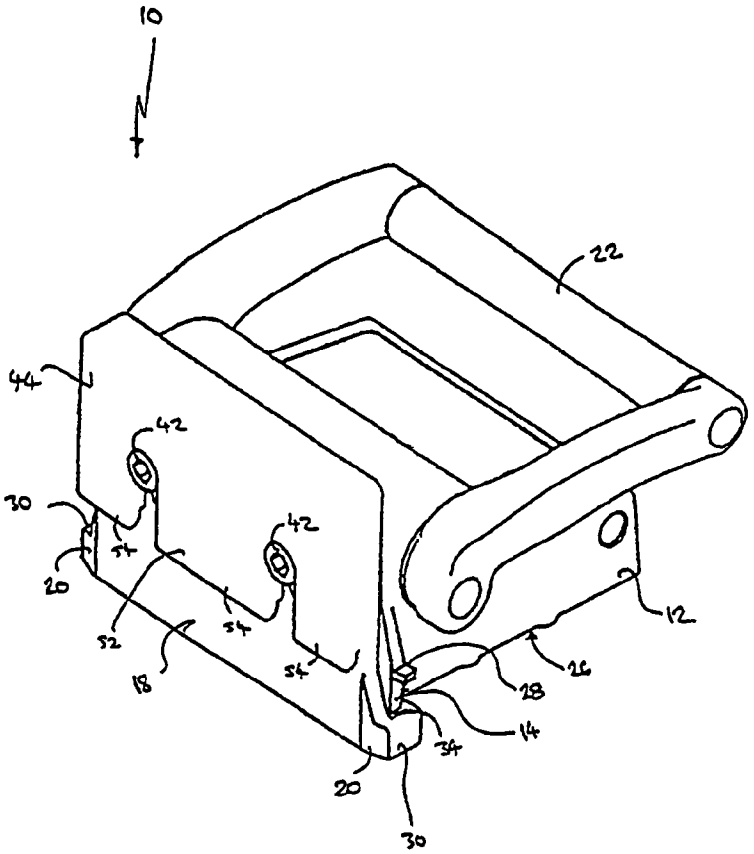
FIG. 3 shows a perspective view of a configuration of the magnetic clamp assembly during attachment of an adapter to a housing of the magnetic clamp assembly.

In order to mount the adapter 18 to the housing 12, the adapter 18 is first moved to the position shown in FIGS. 1 and 2. In this position, the enlarged portion 48 of each opening 46 is aligned with its associated bolt 38. The adapter 18 is then moved towards the front face 16 of the housing 12 such that the head 42 of each bolt 38 passes through the enlarged portion 48 of the associated opening 46 and the exposed part of the shank 40 is positioned in the enlarged portion 48 of the opening 46 as shown in FIGS. 3 and 4. As such, it will be appreciated that the provision of the keyhole-shaped openings 46 allows the adapter 18 to be mounted to, and demounted from, the housing 12 without the need to remove the bolts 38 from the front face 16 of the housing 12.

Figure 6:
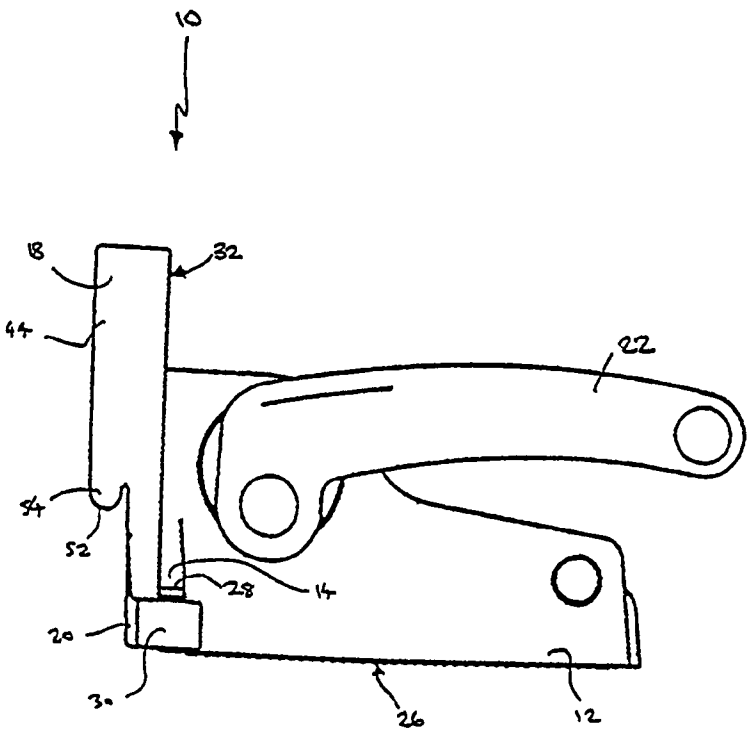
FIG. 6 shows a side view of the magnetic clamp assembly of FIG. 5.
Figure 5:
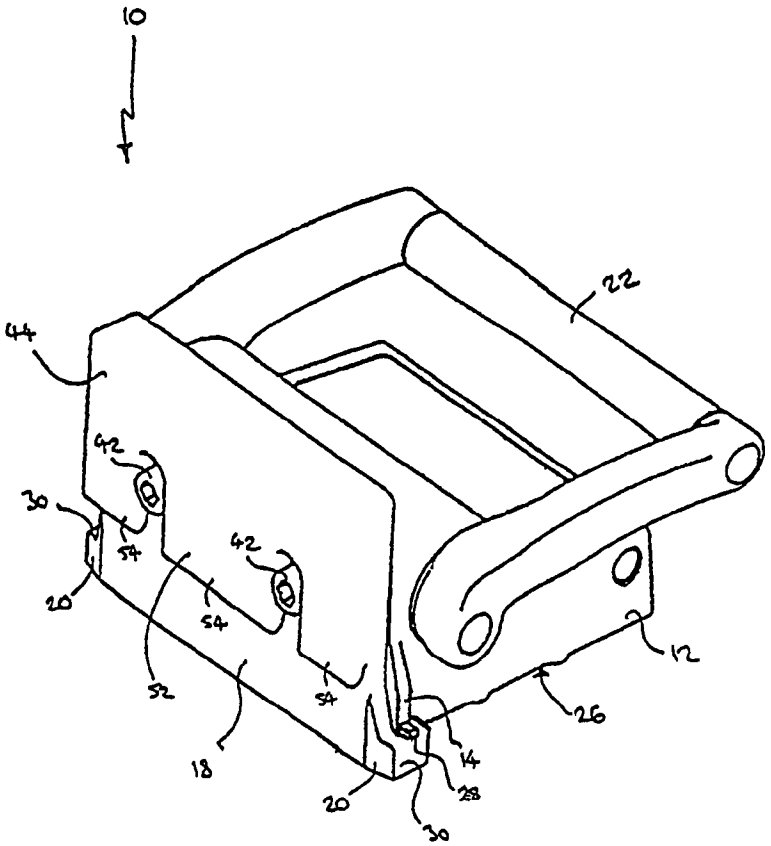
FIG. 5 shows a perspective view of an assembled configuration of the magnetic clamp assembly.

The adapter 18 is then moved upwardly to the mounting position as shown in FIGS. 5 and 6. During this procedure, each engaging component 30 slides over the tab 14 and abuts the lug 28. The part of each shank 40 which protrudes from the housing 12 is now received in the narrower portion 50 of its associated opening 46.

To secure the adapter 18 in its mounting position, the bolts 38 are tightened so that the head 42 of each bolt 38 bears against the body 44 of the adapter 18.

Accordingly, those skilled in the art will appreciate that the bolts 38 secure the adapter 18 in the mounting position and the engagement of the engaging components 30 with the tabs 14 restrains pivoting movement of the adapter 18 about the bolts 38 such that the rear surface 32 of the adapter 18 maintains substantially uniform abutment with the front face 16 of the housing 12.

The adapter 18 defines a bearing member 52 for bearing against an element such as a sideform (not shown) to be clamped in position by the magnetic clamp assembly 10. The bearing member 52 is an interrupted component defining a number of tongues 54 (FIG. 1), the tongues 54 being received in a complementary groove of the sideform.

It is an advantage of at least some embodiments of the invention to provide a magnetic clamp assembly 10 which restrains pivoting movement of an adapter 18 relative to a housing 12 such that concrete structures can be manufactured to desired tolerance levels.

It is a further advantage of at least some embodiments of the invention to provide a magnetic clamp assembly 10 which restrains pivoting movement of an adapter 18 relative to a housing 12 independently of the fasteners used to mount the adapter 18 to the housing 12 and without the need to remove such fasteners when it is desired to replace the adapter 18.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A magnetic clamp assembly for clamping sideforms in position during casting of concrete panels, the magnetic clamp assembly comprising:

a magnetic clamp housing, the housing having a front face, a pair of opposed sides and a pair of restraining formations, each restraining formation projecting outwardly from a respective side of the housing; and an adapter mountable to the housing to bear against the front face, the adapter including an engaging arrangement configured to engage the restraining formations of the housing when the adapter is mounted to the housing, whereby the engagement restrains pivoting movement of the adapter relative to the housing, the adapter including a bearing member for bearing against an element to be supported in position by the magnetic clamp assembly.

2. The assembly of claim 1 wherein each restraining formation is arranged proximate the front face of the housing and is formed integrally with the housing as a one piece unit.

3. The assembly of claim 2 wherein the engaging arrangement includes an engaging element associated with each restraining formation.

4. The assembly of claim 3 wherein each engaging element is of a complementary configuration to the associated restraining formation and is shaped to allow sliding movement of the adapter relative to the housing when mounting the adapter to the housing.

5. The assembly of claim 4 wherein each engaging element is claw-shaped for slidably receiving the associated restraining formation.

6. The assembly of claim 1 wherein the engaging arrangement is integrally formed with the adapter as a one piece unit.

7. The assembly of claim 1 wherein at least one restraining formation includes a limiting structure for limiting travel of the adapter relative to the housing when mounting the adapter to the housing.

8. The assembly of claim 7 wherein the engaging arrangement of the adapter interacts with the limiting structure when the adapter is in an operative position relative to the housing.

9. The assembly of claim 1 wherein the adapter includes mounting formations for receiving securing elements to releasably mount the adapter to the housing.

10. The assembly of claim 9, further comprising:

the securing elements arranged in a spaced relationship and projecting from the front face of the housing.

11. The assembly of claim 10 wherein each mounting formation is an opening in the adapter shaped to receive a respective securing element.

12. The magnetic clamp assembly of claim 1 wherein the adapter is slidably mountable to the front face of the housing and, wherein, each restraining formation of the magnetic clamp housing is configured to slidably receive the engaging arrangement of the adapter to restrain pivoting movement of the adapter relative to the housing.

* * * * *